United States Patent [19]

Weber et al.

[11] 4,197,922

[45] Apr. 15, 1980

[54] AIR INTAKE PIPE FOR AN INTERNAL COMBUSTION ENGINE

[75] Inventors: Otto Weber; Volkmar Keck; Rolf Engelking, all of Wolfsburg, Fed. Rep. of Germany

[73] Assignee: Volkswagenwerk Aktiengesellschaft, Wolfsburg, Fed. Rep. of Germany

[21] Appl. No.: 881,547

[22] Filed: Feb. 27, 1978

[30] Foreign Application Priority Data

Mar. 30, 1977 [DE] Fed. Rep. of Germany ..... 2714100

[51] Int. Cl.[2] ..... F01N 1/06

[52] U.S. Cl. ..... 181/229; 55/276; 55/DIG. 21; 138/115; 138/DIG. 11

[58] Field of Search ..... 55/276, DIG. 21; 181/206, 227, 229, 247–251; 138/115, DIG. 11

[56] References Cited

U.S. PATENT DOCUMENTS

| | | | |
|---|---|---|---|
| 2,056,608 | 10/1936 | Jack | 181/248 |
| 2,827,124 | 3/1958 | Woodbury | 181/251 |
| 2,886,129 | 5/1959 | Streete | 55/276 |
| 3,039,254 | 6/1962 | Thornburgh | 55/276 |
| 3,114,432 | 12/1963 | Ludlow et al. | 181/227 |

*Primary Examiner*—Kathleen J. Prunner

*Attorney, Agent, or Firm*—Brumbaugh, Graves, Donohue & Raymond

[57] ABSTRACT

An air intake pipe, for mounting to the air filter of an internal combustion engine has two air flow channels having different lengths. A duct is provided between the air flow channels connecting them over their entire length. The duct is dimensioned to provide both sound attenuation and acoustic wave interference between intake noises in the two channels. Thus, the intake pipe acts as an intake noise silencer.

5 Claims, 3 Drawing Figures

AIR INTAKE PIPE FOR AN INTERNAL COMBUSTION ENGINE

BACKGROUND OF THE INVENTION

This invention relates to air intake pipes for mounting to the air filter on an internal combustion engine, and particularly to such pipes as are designed to suppress engine intake noises.

German Utility Model No. 1,900,418 discloses air intake pipes for use with the air filter of an internal combustion engine wherein there are provided multiple air-flow channels to cause acoustic wave interference between air intake noises, which arise during engine operation. Similar air intake silencing apparatus is described in an article in MTZ Magazine, No. 1940, page 49. In that article, there is also described a noise silencing intake pipe which is provided with holes, open to the surrounding air and arranged to act as a high pass filter for engine intake noises.

The prior art arrangements are particularly adapted to suppress low frequency engine noises or noises of a dominant frequency by providing interference or filtering.

It is an object of the present invention to provide a new and improved air intake pipe which provides the suppression of engine noises over a wide frequency range.

It is a further object of the present invention to provide such an apparatus which provides noise suppression by frictional acoustic damping as well as by acoustic wave interference.

SUMMARY OF THE INVENTION

In accordance with the present invention, there is provided an air intake pipe for mounting to an air filter in an internal combustion engine. The pipe includes first and second air-flow channels having different lengths and connected to each other over their entire lengths by a duct. The duct is dimensioned to provide both sound attenuation and acoustic wave interference thereby to suppress engine intake noises.

In accordance with the invention, the air-flow channels may have different cross-sectional areas, and the cross-sectional areas may be tapered to increase in the air-flow direction. One of the air-flow channels may be provided with additional length by extending the channel into the air filter. It is preferred that the longer air-flow channel be at least 3 cm. longer than the other air-flow channel. The duct preferably has a width of between 1 and 2 mm. to provide acoustic wave attenuation by frictional damping of acoustic waves passing between the two channels.

The intake pipe arrangement of the present invention can be constructed from two shaped metal plates without any difficulty as compared to prior art pipes of similar design. By providing different dimensions for the various air flow channels, it becomes possible, in connection with the presence of the duct between the channels, to provide effective noise suppression over a wide frequency range. The width of the duct, preferably between about 1 and 2 mm. is selected to facilitate noise suppression not only by acoustic wave interference, but also by frictional damping of the acoustic wave flow through the duct which results from pressure equalization between the air flow channels. In addition to these noise suppressing mechanisms, there is also a decrease in sound propagation by reason of reflections, so that the intake pipe of the present invention, which has minimal additional space requirements, provides a highly effective noise suppression arrangement. To save space, the longer pipe of the invention may extend into the air filter. The intake pipe design does not require any particular air filter arrangement and can therefore be used with a wide variety of existing filters.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
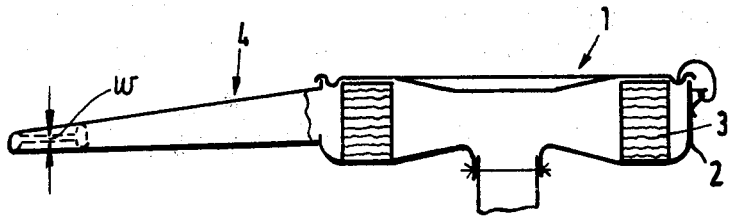
FIG. 1 is a partially sectional side view of an air filter which is provided with an intake pipe in accordance with the present invention.
Figure 2:
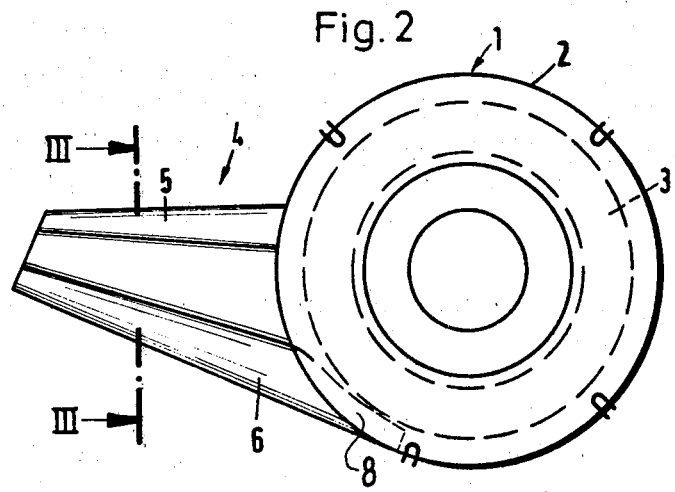
FIG. 2 is a top view of the FIG. 1 air filter and pipe.

Referring to FIGS. 1 and 2, there is shown an intake air filter 1 which is adapted for use with an internal combustion engine, such as an automobile engine. The air filter 1 comprises a cylindrical filter housing 2 within which a filter element 3 is positioned. Air enters the air filter housing through an inlet pipe 4, passes in an inward radial direction through filter element 3 and enters the engine through a centrally located outlet, at the bottom of housing 2 in FIG. 1. While a particular configuration for the air filter is illustrated in the drawings, those skilled in the art will recognize that the present invention may be easily adapted for use with other types of air filters.

Figure 3:
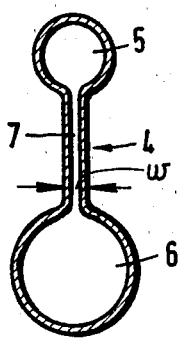
FIG. 3 is a cross-sectional view of the intake pipe of FIGS. 1 and 2.

In accordance with the invention, air inlet or intake pipe 4 is provided with two air-flow channels 5 and 6. As may be seen from the cross-section of FIG. 3, air-flow channel 6 is somewhat larger in average cross-sectional area than air-flow channel 5. In the embodiment illustrated, the air flow channels have an approximately circular cross-section and are tapered to a larger cross-sectional area at the point the air-flow channels enter filter housing 2. It has been determined that air-flow channels 5 and 6 preferably have a diameter ratio of approximately 3:5. As indicated in FIG. 2, air-flow channel 6 has an extension 8 into the interior of filter housing 2 in a circumferential direction, so that it is provided with an additional channel length than would otherwise be available.

Air-flow channels 5 and 6 are connected with each other over their entire length by a duct 7, which is formed between parallel walls connecting the two air flow channels. It has been determined that the duct 7 preferably has a relatively small width w in the direction perpendicular to the direction between the air-flow channels, the width being between 1 and 2 mm. Duct 7 provides acoustic energy dissipation through frictional damping and also provides acoustic wave attenuation through interference between acoustic waves in the two air-flow channels. Duct 7 interconnects channels 5 and 6 over the entire length of pipe 4, and as shown in FIGS. 1 and 2 is open at both ends of pipe 4. The duct assures acoustic interference between waves in channels 5 and 6 for sound frequencies above 500 Hz. It has been found that the two air-flow channels should have a length which is different by a minimum of three cm.

By the arrangement of the present invention, which provides acoustic wave interference, frictional damping and acoustic wave reflection, it has been found that the intake noise of an internal combustion engine can be reduced substantially. In addition, the air intake pipe of the present invention can be easily implemented with a variety of air intake arrangements, and does not require substantial additional space over prior art noise suppression arrangements.

While there has been described what is believed to be the preferred embodiment of the present invention, those skilled in the art will recognize that other and further modifications may be made thereto without departing from the spirit of the invention, and it is intended to claim all such embodiments as fall within the true scope of the invention.

We claim:

1. An air filter housing assembly for an internal combustion engine comprising an air filter housing and an air intake pipe mounted on said filter housing including first and second air-flow channels having different lengths each of said channels including a continuous opening extending longitudinally substantially along the entire length of each channel, and a duct interconnecting the openings in the channels throughout substantially their entire length, whereby said duct suppresses engine intake noise.

2. An air intake pipe as specified in claim 1 wherein said air-flow channels have different average cross-sectional areas.

3. An air intake pipe as specified in claim 1 wherein at least the longest channel extends into said air filter housing.

4. An air intake pipe as specified in claim 1 wherein said second air-flow channel is at least 3 cm. greater in length than said first air-flow channel.

5. An air intake pipe as specified in claim 1 wherein said duct has a width of between 1 and 2 mm.

* * * * *